United States Patent [19]

Richter

[11] Patent Number: 4,585,146

[45] Date of Patent: Apr. 29, 1986

[54] OPEN TOP TANK WITH FLOW RATE CONTROL DEVICE THEREIN

[75] Inventor: Simon J. Richter, Marietta, Ga.

[73] Assignee: The Coca-Cola Company, Atlanta, Ga.

[21] Appl. No.: 504,864

[22] Filed: Jun. 16, 1983

[51] Int. Cl.[4] ..... B65D 25/04; B65D 25/32

[52] U.S. Cl. ..... 222/1; 222/129.1; 222/481; 222/547

[58] Field of Search ..... 222/478, 479, 481, 481.5, 222/547, 564, 1, 129.1–129.4

[56] References Cited

U.S. PATENT DOCUMENTS

| | | | |
|---|---|---|---|
| 379,738 | 3/1888 | Sutphen | 222/481 X |
| 989,865 | 4/1911 | O'Connor | 222/478 UX |
| 2,036,739 | 4/1936 | Arnold | 222/564 X |
| 3,297,211 | 1/1967 | Unger | 222/547 X |
| 3,991,219 | 11/1976 | Kückens | 222/129.4 X |

*Primary Examiner*—Joseph J. Rolla
*Assistant Examiner*—Frederick R. Handren
*Attorney, Agent, or Firm*—Birch, Stewart, Kolasch & Birch

[57] ABSTRACT

A refillable syrup tank for use in a post-mix beverage dispenser including an open top through which the tank may be refilled and a discharge end at the bottom. A flow rate control assembly is mounted within the tank and includes a flow rate control tube extending from the top of the tank to a position spaced from the discharge opening. A diaphragm is connected between the bottom of the tube and the tank sidewalls. Weep holes are provided in the diaphragm to permit the flow of syrup therethrough.

15 Claims, 2 Drawing Figures

OPEN TOP TANK WITH FLOW RATE CONTROL DEVICE THEREIN

BACKGROUND OF THE INVENTION

The present invention relates to an open top tank, including a flow rate control device therein for regulating the flow rate of liquid dispensed through a discharge opening thereof. More specifically, the present invention relates to an open top syrup supply tank for a post-mix beverage dispenser system having means therein for controlling the rate of flow of syrup dispensed to a mixing station in the dispenser system.

Heretofore, many types of syrup supply packages, containers or tanks for post-mix beverage dispenser systems have been developed which include flow rate control tubes within the tank for providing an even and steady flow of syrup to mixing stations in post-mix beverage dispensers. Exemplary of such a package or container is that described in U.S. Pat. No. 4,216,885 to Sedam, issued Aug. 12, 1980, and assigned to the same assignee as the present invention. In the Sedam syrup package, a flow rate control tube 18 is provided in a container 12. Flow rate control tube 18 has an open end 18A disposed a predetermined distance above a discharge opening formed in the container neck and an openable sealed end 18B extending through the bottom 22A of the container. When the openable sealed end 18B is opened, atmospheric pressure is established through tube 18, all the way to the point of the position of open end 18A, creating a hydrostatic pressure head which controls the rate of flow of syrup out of the container. In operation within a post-mix beverage dispenser system, the plastic bottle or syrup package of Sedam is inverted and inserted into a valve mechanism socket of the dispenser against a sharp piercing device. The piercing device ruptures a membrane 22B, extending across the open end of the syrup package to form a dispensing outlet therein. The sealed end of the tube 18B is then ruptured to permit the flow of air through the tube and, therefore, establishes atmospheric pressure at the open end 18A of the tube above the discharge opening. A pressure balance is then created within the bottle as the syrup is withdrawn and replaced by air, and from this point on, the tube 18 in the bottle functions to control the rate of flow of syrup at a substantially constant rate as the syrup is dispensed from the bottle.

Other examples of the use of flow rate control tubes in syrup packages can be found in U.S. Pat. No. 3,258,166 to Kuckens, issued June 28, 1966; U.S. Pat. No. 3,991,219 to Kuckens, issued Nov. 19, 1976; and U.S. Pat. 3,807,607 to Kuckens, issued Apr. 30, 1974.

The above patents to Sedam and Kuckens are quite effective in controlling the flow rate of syrup from a container. However, in each of the above syrup containers, the bottom, or top of the container once it becomes inverted, is closed, and venting to the atmosphere by the flow rate control tube is through the closed bottom. Because of this closed bottom, these containers must be filled through the discharge opening preparatory to use or loading in the post-mix beverage dispenser system. While this filling procedure is satisfactory for mass loading in a factory, it may be more cumbersome than desired for refilling containers on site at post-mix beverage dispenser locations.

Accordingly, a need in the art exists for a syrup container or tank which may be readily refilled from the top, or the end of the container opposite the discharge opening rather than through the discharge opening. However, to implement such an open top container which is easily refillable in its operative vertical position without removal from a post-mix beverage dispensing system, creates the perplexing problem as to how to dispose a flow rate control tube therein absent the presence of a container end wall which normally supports the tube, and how to make such a flow rate control tube function properly in the presence of an open top container having the upper surface of the liquid being dispensed fully exposed to the atmosphere.

SUMMARY OF THE INVENTION

Accordingly, it is a primary object of the present invention to provide a syrup tank for a post-mix beverage dispenser system of the gravity flow type, which has an open top through which it may be refilled and suitable means therein for supporting a flow rate control tube and aiding the operation thereof to provide a constant discharge rate of syrup therefrom.

It is a further object of the present invention to provide a device for supporting a flow rate control tube along the longitudinal axis of a syrup container and distributing and establishing atmospheric pressure in the syrup being dispensed along a planar region disposed a predetermined distance above the discharge opening of the container.

The objects of the present invention are fulfilled by providing an apparatus for dispensing liquids with a controlled rate of flow comprising: a container with a top end opened to the atmosphere, a bottom end with a discharge opening therein and sidewalls connecting said top and bottom ends; a flow rate control tube having a top open end adjacent the top end of said container and a bottom open end disposed at a predetermined distance above said discharge opening, said tube establishing atmospheric pressure at said bottom open end thereof; and diaphragm means extending between said flow rate control tube and said container sidewalls just above said bottom open end of said tube to confine said atmospheric pressure below said diaphragm means and to support said flow rate control tube within said container, said diaphragm means including weep hole means through which the liquid being dispensed may pass.

The diaphragm is attached to the flow rate control tube just above the bottom open end thereof and its upper surface slopes downwardly from the region adjacent the flow rate control tube toward the container sidewalls. A plurality of spaced weep holes are provided around the periphery of the diaphragm in regions adjacent the container sidewalls. Therefore, because of the sloping of the upper surface of the diaphragm, syrup thereabove will run downwardly and bleed through the weep holes. The size of the weep holes are selected so that syrup will flow therethrough at a rate equal to or slightly less than the flow rate of the syrup out of the dispensing opening.

BRIEF DESCRIPTION OF THE DRAWINGS

The objects of the present invention and the attendant advantages thereof will become more readily apparent by reference to the accompanying drawings wherein.

DETAILED DESCRIPTION OF THE DRAWINGS

Figure 1:
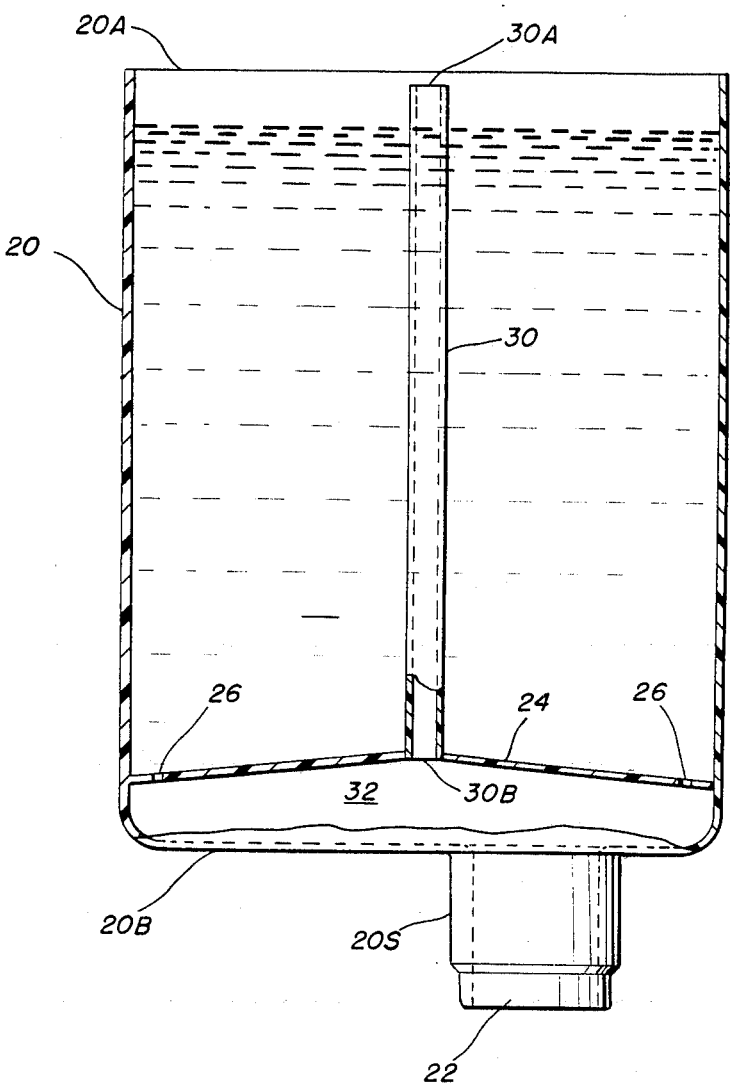
FIG. 1 is a side elevational view partially in section showing a syrup tank in accordance with the present invention with a flow rate control tube and diaphragm mechanism therein.
Figure 2:
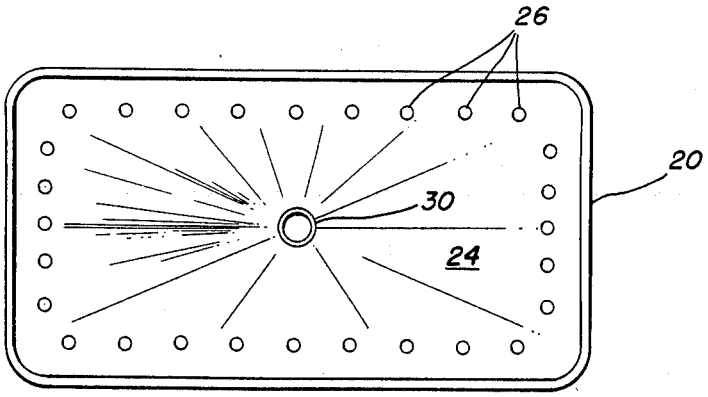
FIG. 2 is a top plan view of a syrup tank of the type illustrated in FIG. 1 showing the distribution of the weep holes in the diaphragm.

Referring to FIG. 1, there is generally indicated a syrup tank 20 which may be plastic, metal or any other liquid-impervious material having a completely open top end 20A and a closed bottom end 20B with a discharge spout 20S therein defining a discharge opening 22. Disposed within the syrup tank 20 is a flow rate control tube 30 having an open top end 30A and an open bottom end 30B. Secured to the periphery of the open bottom end 30B is a diaphragm 24 having a plurality of weep holes 26 therein which are in a preferred embodiment equally spaced around the periphery thereof as illustrated in FIG. 2. Of course, many different types of distributions and numbers of weep holes 26 may be used without departing from the spirit and scope of the present invention.

Tube end 30B and diaphragm 24 are disposed at a predetermined position above discharge opening 22 and by virtue of tube 30 and open end 30A being open to the atmosphere, establish atmospheric pressure in the liquid 32 below diaphragm 24. Of course, it should be understood that liquid is also provided in the region 34 above diaphragm 24 when the syrup tank 20 is filled. The creation of atmospheric pressure in the liquid 32 below diaphragm 24 creates a pressure balance in the container which assures a substantially constant rate of flow of syrup through spout 20S and out of discharge opening 22.

When connected to a post-mix beverage dispenser valving mechanism, spout 20S of tank 20 is inserted into a socket on the top of that valve mechanism and therefore the opening and closing of the valve mechanism initiates or terminates the flow of syrup out of tank 20. A valving mechanism of this general type is generally disclosed in the aforementioned Sedam Patents, which are incorporated herein by reference.

Diaphragm 24, as clearly illustrated in FIG. 1, has a top surface which is sloped from its point of attachment to tube 30 downwardly to the sidewalls of the container 20. Therefore, it can be seen that the syrup 34 above the diaphragm tends to flow down the top surface of the diaphragm and out of weep holes 26. The weep holes 26 are dimensioned so that the flow of syrup therethrough from region 34 to region 32 is at the same flow rate or slightly less than the flow rate of syrup out of the dispenser opening 22.

In operation, with the post-mix beverage dispenser valving mechanism closed, the syrup is at the same level in the tank 20 and the tube 30 and is present below diaphragm 24 in the region 32. With the weep holes 26 each being appreciably smaller than the tube end 30B, as shown in FIGS. 1 and 2, and the syrup flowing through the weep holes at the same flow rate or slightly less than the flow rate of syrup out of the dispenser opening 22, syrup will flow out of the tube end 30B upon the opening of the valving mechanism to allow syrup to flow out of the dispenser opening 22. Thus, atmospheric pressure in the container below the diaphragm will be established after an initial dispensing interval during which the liquid in the flow rate control tube drops to the level of the bottom end of the tube.

The flow rate control tube and a diaphragm are preferably fabricated from a polyolefin, such as polyethylene, polypropylene or copolymers thereof. The tube may be secured to the diaphragm with an adhesive or heat seal thereto. In the alternative, the diaphragm may be heat shrunk around the tube.

The syrup tank is preferably formed from plastic such as PET (polyethylene terephthalate) or other moldable plastics. Of course, a metal tank could be used if desired.

The diaphragm can be secured within the tank at the proper position by means of an adhesive, heat seal or even a force fit by providing a diaphragm with a slightly larger outside diameter than the inside diameter of the tank.

It should be understood that the flow rate control mechanism of the present invention may be modified, as would occur to one of ordinary skill in the art without departing from the spirit and scope of the present invention.

What is claimed is:

1. An apparatus for dispensing liquids with a controlled rate of flow comprising:
   - a container with a top end, opened to the atmosphere, a bottom end with a discharge opening therein and sidewalls connecting said top and bottom ends;
   - a flow rate control tube having a top end, opened to the atmosphere, adjacent the top end of said container and a bottom open end disposed at a predetermined distance above said discharge opening, said tube establishing atmospheric pressure at said bottom open end thereof after an initial dispensing interval; and
   - diaphragm means extending between said flow rate control tube and said container sidewalls just above said bottom open end of said tube to establish said atmospheric pressure below said diaphragm means and to support said flow rate control tube within said container, said diaphragm means including weep hole means through which the liquid being dispensed may pass.

2. The apparatus of claim 1, wherein the upper surface of said diaphragm means slopes downwardly from regions adjacent said tube to said container sidewalls.

3. The apparatus of claim 2, wherein said weep hole means are disposed adjacent said container sidewalls.

4. The apparatus of claim 1, wherein said weep hole means comprises a plurality of holes symmetrically spaced around said diaphragm means.

5. The apparatus of claim 2, wherein said weep hole means comprises a plurality of holes symmetrically spaced around said diaphragm means.

6. In a post-mix beverage dispenser, an apparatus for dispensing syrup at a controlled rate of flow comprising:
   - a container with a top end, opened to the atmosphere, a bottom end with a discharge opening therein and sidewalls connecting said top and bottom ends;
   - a flow rate control tube having a top end, opened to the atmosphere, adjacent the top end of said container and a bottom open end disposed at a predetermined distance above said discharge opening, said tube establishing atmospheric pressure at said bottom open end thereof after an initial dispensing interval; and
   - diaphragm means extending between said flow rate control tube and said container sidewalls just above said bottom open end of said tube to establish said atmospheric pressure below said diaphragm means and to support said flow rate control tube within said container, said diaphragm means including weep hole means through which the liquid being dispensed may pass.

7. The apparatus of claim 6, wherein the upper surface of said diaphragm means slopes downwardly from regions adjacent said tube to said container sidewalls.

8. The apparatus of claim 7, wherein said weep hole means are disposed adjacent said container sidewalls.

9. The apparatus of claim 6, wherein said weep hole means comprises a plurality of holes symmetrically spaced around said diaphragm means.

10. The apparatus of claim 7, wherein said weep hole means comprises a plurality of holes symmetrically spaced around said diaphragm means.

11. A method for supplying syrup to a post-mix beverage dispenser at a controlled rate of flow comprising the steps of:

providing a syrup tank including a container with a top end open to the atmosphere, a bottom end with a discharge opening therein and sidewalls connecting said top and bottom ends;

a flow rate control tube having a top open to the atmosphere end adjacent the top end of said container and a bottom open end disposed at a predetermined distance above said discharge opening, said tube establishing atmospheric pressure at said bottom open end thereof after an initial dispensing interval, and diaphragm means extending between said flow rate control tube and said container sidewalls just above said bottom open end of said tube to confine said atmospheric pressure below said diaphragm means and to support said flow rate control tube within said container, said diaphragm means including weep hole means through which the liquid being dispensed may pass;

filling said tank with syrup through the top open end of said container;

connecting said discharge end of said container with a dispensing valve mechanism of said post-mix beverage dispenser; and actuating said dispenser valve mechanism to cause said syrup to be dispensed therethrough.

12. The method of claim 11, wherein the upper surface of said diaphragm means slopes downwardly from regions adjacent said tube to said container sidewalls.

13. The method of claim 12, wherein said weep hole means are disposed adjacent said container sidewalls.

14. The method of claim 11, wherein said weep hole means comprises a plurality of holes symmetrically spaced around said diaphragm means.

15. The method of claim 12, wherein said weep hole means comprises a plurality of holes symmetrically spaced around said diaphragm means.

* * * * *